US005759954A

United States Patent [19]

Taguchi et al.

[11] Patent Number: 5,759,954

[45] Date of Patent: Jun. 2, 1998

[54] TRANSFER MEMBER AND THERMAL TRANSFER PRINTING METHOD

[75] Inventors: Nobuyoshi Taguchi; Akihiro Imai, both of Nara; Atsushi Sogami, Hyogo; Yasuo Fukui, Osaka; Masanori Yoshikawa, Osaka; Hiroyuki Matsuo, Osaka, all of Japan

[73] Assignee: Matsushita Electric Industrial Co., Ltd., Osaka, Japan

[21] Appl. No.: 544,257

[22] Filed: Oct. 17, 1995

[30] Foreign Application Priority Data

Oct. 20, 1994 [JP] Japan ..... 6-254958
Mar. 14, 1995 [JP] Japan ..... 7-054415

[51] Int. Cl.[6] ..... B41M 5/035; B41M 5/38

[52] U.S. Cl. ..... 503/227; 156/235; 428/195; 428/913; 428/914

[58] Field of Search ..... 8/471; 428/195, 428/913, 914; 503/227; 156/235

[56] References Cited

U.S. PATENT DOCUMENTS

| | | | |
|---|---|---|---|
| 5,134,112 | 7/1992 | Kanto et al. | 503/227 |
| 5,214,023 | 5/1993 | Aono | 503/227 |
| 5,284,814 | 2/1994 | Taguchi | 503/227 |
| 5,447,902 | 9/1995 | Imai et al. | 503/227 |

FOREIGN PATENT DOCUMENTS

| | | | |
|---|---|---|---|
| 88-281888 | 11/1988 | Japan | 503/227 |
| 02-227294 | 9/1990 | Japan | 503/227 |

*Primary Examiner*—Bruce H. Hess
*Attorney, Agent, or Firm*—Merchant, Gould, Smith, Edell, Welter & Schmidt, P.A.

[57] ABSTRACT

A transfer member includes a dyeing layer transfer member, which has a lubricating heat-resistant layer on the reverse surface of a first base material and laminated layers of a parting layer and a dyeing layer on the obverse surface, an ink transfer member, having a lubricating heat-resistant layer on the reverse surface of a second base material and the laminated layers of an adhesive layer and an ink layer, an intermediate member having a functional layer on a third base material, and an image-receptor. A thermal transfer printing method includes the steps of thermally transferring the dyeing layer onto the functional layer by setting a thermal head in contact with the lubricating heat-resistant layer of the dyeing layer transfer member, thermally transferring dye of the ink layer onto the dyeing layer that was transferred onto the functional layer in response to picture signals by setting the thermal head in contact with the lubricating heat-resistant layer of the ink transfer member, and thermally transferring the dyeing layer recorded with the dye onto the main surface of the image-receptor. Thus, pictorial images of high quality are formed on the image-receptor, and thermal transfer printing can be carried out repeatedly and stably.

4 Claims, 4 Drawing Sheets

TRANSFER MEMBER AND THERMAL TRANSFER PRINTING METHOD

FIELD OF THE INVENTION

This invention relates to a transfer member for stably carrying out dye thermal transfer printing so as to form high quality full-color images on any image-receptor, and further relates to a thermal transfer printing method for printing full-color images of high quality on the entire surface of an image-receptor.

BACKGROUND OF THE INVENTION

The dye thermal transfer printing method is capable of providing an image of high quality equal to that of color photography, and an apparatus employed in the method is compact, is easily maintained and can operate instantaneously. In the dye thermal transfer printing method, a transfer member having a coloring material layer, which contains subliming dye, on a thin film base, and an image-receptor having a dyeing layer on a thick film such as a synthetic paper or the like, are overlapped on each other, and the subliming dye is transferred into the dyeing layer by a thermal recording head, thus recording a mixed color image of dye molecules.

On the other hand, in order to affix the printed image onto various materials, the method of employing tack sheets has been proposed. In this method, the image-receptor has a double-layer structure, and an adhesive material is applied onto a reverse surface of a base material formed with an upper dyeing layer so that the base material is fixed on a support member formed with a lower parting layer. After printing, the upper layer is separated or peeled off and then is fixed on a post-card, etc.

Printed images made by the dye thermal transfer printing method are formed on specially prepared paper sheets, so that the running cost is high, preventing the printing technique from spreading widely to general applications.

Moreover, in this multi-media age, information includes images mixed with characters. Even though there is a strong demand for printing such information on plain paper in a similar manner as in a copying apparatus, it has been impossible to obtain an image of high quality on a plain paper sheet by the conventional dye thermal transfer printing method.

Thus, U.S. Pat. No. 5,284,814 discloses a dye thermal transfer printing method for forming full-color picture images of high quality on any image-receptor. In the method, a dyeing layer transfer member having a lubricating heat-resistant layer on the reverse surface of a first base material and a dyeing layer on the other surface, an ink transfer member having a lubricating heat-resistant layer on the reverse surface of a second base material and an ink layer on the other surface, an intermediate member having a functional layer on a third base material, and an image-receptor are all used. The dyeing layer is thermally transferred onto the functional layer of the intermediate member; dye in the ink layer is thermally transferred and recorded in response to image signals onto the dyeing layer—which was transferred on the functional layer—by setting a thermal head in contact with the lubricating heat-resistant layer; the dyeing layer recorded with the dye is then thermally transferred onto the main surface of the image-receptor.

However, it is difficult to repeatedly form full-color picture images of high quality with stability by the conventional dyeing layer transfer member and ink transfer member, especially without influence by the surrounding environment.

Moreover, in the above-mentioned conventional dye thermal transfer printing method, unrecorded spaces are formed around the peripheral section of an image-receptor, and it is impossible to form picture images on the entire surface of an image-receptor.

SUMMARY OF THE INVENTION

It is an object of this invention to provide a transfer member which can stably and repeatedly print full-color picture images of high quality by the dye thermal transfer printing method mentioned above.

Another object of this invention is to provide a transfer member which can stably and repeatedly print full-color picture images of high quality by the above-mentioned printing method without influence by the surrounding environment.

It is also another object of this invention to provide a thermal transfer printing method which can record picture images on the entire surface of an image-receptor.

In order to accomplish these and other objects and advantages, a transfer member of this invention includes a dyeing layer transfer member having a lubricating heat-resistant layer on the reverse surface of a first base material and laminated layers of a parting layer and a dyeing layer on the other surface of the first base material, an ink transfer member having a lubricating heat-resistant layer on the reverse surface of a second base material and laminated layers of an adhesive layer and an ink layer on the other surface of the base material, an intermediate member having a functional layer on a third base material, and an image-receptor. The dyeing layer is thermally transferred onto the functional layer of the intermediate member by setting a thermal head in contact with the lubricating heat-resistant layer of the dyeing layer transfer member. The thermal head is in contact with the lubricating heat-resistant layer of the ink transfer member, so that the dye in the ink layer is thermally transferred and recorded onto the dyeing layer, which was transferred onto the functional layer in response to picture signals. The dyeing layer recorded with dye is thermally transferred onto the surface of the image-receptor. The ink layer contains polyacrylonitrile resin and at least one resin selected from the group consisting of (a) polyvinylchloride resin, (b) copolymer resin of polyvinylchloride and polyvinyl acetate resin, and (c) copolymer resin of polyvinylchloride, polyvinyl acetate resin and polyvinylalcohol resin at a ratio of 2:8 or 8:2, so that the layer has preferable heat-resistant properties and flexibility. The ink layer is adhered to the adhesive layer with sufficient adhesive strength, so that the layer is stable during winding and memory periods under high temperature and the recording process.

It is preferable that the resin constituting the adhesive layer on the base material has an adhesiveness of 20 g/inch at 50° C. or higher with the ink layer. Thus, the recording process becomes stable for repeated use.

It is also preferable that the resin constituting the adhesive resin has a glass transition point of 40° C. or higher. Therefore, even if the intermediate member is heated at 50°–60° C., blocking between the ink layer and the adhesive layer does not occur and the recording process becomes stable for repeated use.

It is further preferable that the base material is used as the second base material of the ink transfer member and as the first base material of the dyeing layer transfer member, so that the recording process is carried out with a small occupying space.

Another transfer member of this invention includes a dyeing layer transfer member having a lubricating heat-resistant layer on the reverse surface of a first base material and laminated layers of a parting layer and a dyeing layer on the other surface of the first base material, an ink transfer member having a lubricating heat-resistant layer on the reverse surface of a second substrate and laminated layers of an adhesive layer and an ink layer on the other surface of the base material, an intermediate member having a functional layer on a third base material, and an image-receptor. The dyeing layer is thermally transferred onto the functional layer of the intermediate member by setting a thermal head in contact with the lubricating heat-resistant layer of the dyeing layer transfer member. The thermal head is in contact with the lubricating heat-resistant layer of the ink transfer member, so that the dye in the ink layer is thermally transferred and recorded on the dyeing layer, which was transferred onto the functional layer in response to picture signals. The heat-resistant properties of the dyeing layer gradually increase from the surface in contact with the parting layer to the outside surface of the dyeing layer. A section of the dyeing layer with low heat-resistant properties is in contact with the ink layer during the recording process, thereby increasing memory sensitivity. During the winding and memory process at high temperature, the section of high heat-resistant properties is in contact with the lubricating heat-resistant layer, so that problems such as adhesion between the layers can be prevented.

Another transfer member of this invention includes a dyeing layer transfer member having a lubricating heat-resistant layer on the reverse surface of a first base material and laminated layers of a parting layer and a dyeing layer on the other surface of the first base material, an ink transfer member having a lubricating heat-resistant layer on the reverse surface of a second substrate and laminated layers of an adhesive layer and an ink layer on the other surface of the base material, an intermediate member having a functional layer on a third base material, and an image-receptor. The dyeing layer is thermally transferred onto the functional layer of the intermediate member by setting a thermal head in contact with the lubricating heat-resistant layer of the dyeing layer transfer member. The thermal head is in contact with the lubricating heat-resistant layer of the ink transfer member, so that the dye in the ink layer is thermally transferred and recorded on the dyeing layer, which was transferred onto the functional layer in response to picture signals. Then, the dyeing layer recorded with the dye is thermally transferred onto the surface of the image-receptor. The dyeing layer has a two-layer structure of a first dyeing layer, which is in contact with the parting layer, and a protective layer coating the first dyeing layer, or a three-layer structure of the first dyeing layer, the protective layer, and an intensity reinforcing layer. Thus, the dyeing layer has a stability and strength. The recording process becomes stable particularly with the dyeing layer of the three-layer structure.

It is preferable that the first dyeing layer includes polyvinyl butyral resin or polyvinyl acetal resin with a 60° C. glass transition point (Tg) less than 60° C. and a releasing agent: that the protective layer contains mixed resins of polyvinyl butyral resin or polyvinyl acetal having different glass transition points (Tg) above 70° C. and has a surface area for coating the entire surface of the first dyeing layer: and that the intensity reinforcing layer contains polyvinyl butyral resin or polyvinyl acetal resin having a glass transition point (Tg) higher than a 100° C., has a surface area smaller than the perimeter of the protective layer, and has high heat-resistant properties. Thus, the transfer member is stable and has superior recording sensitivity. Moreover, the dyeing layer can prevent adhesion with the lubricating heat-resistant layer during the winding and memory process at high temperature.

Another transfer member of this invention includes a dyeing layer transfer member having a lubricating heat-resistant layer on the reverse surface of a first base material and laminated layers of a parting layer and a dyeing layer on the other surface of the first base material, an ink transfer member having a lubricating heat-resistant layer on the reverse surface of a second substrate and laminated layers of an adhesive layer and an ink layer on the other surface of the base material, an intermediate member having a functional layer on a third base material, and an image-receptor. The dyeing layer is thermally transferred onto the functional layer of the intermediate member by setting a thermal head in contact with the lubricating heat-resistant layer of the dyeing layer transfer member. The thermal head is in contact with the lubricating heat-resistant layer of the ink transfer member, so that the dye in the ink layer is thermally transferred and recorded on the dyeing layer already transferred onto the functional layer in response to picture signals. Then, the dyeing layer recorded with the dye is thermally transferred onto the surface of the image-receptor. The resin constituting the surface area of the dyeing layer, which is in contact with the ink layer, and the resin constituting the ink layer are not compatible to each other. Thus, the dyeing layer does not thermally fuse with the ink layer of the ink transfer member during the recording process. After the recording process, the dyeing layer can be easily peeled off from the ink layer, thereby carrying out the recording process stably.

It is preferable that the resin constituting a surface area of the dyeing layer which is in contact with the ink layer is at least one resin selected from the group consisting of polyvinyl butyral and polyvinyl acetal, and that resin constituting the ink layer is at least one resin selected from the group consisting of polyacrylonitrile styrene resin, polyvinylchloride resin, polyvinyl acetate resin, polyvinylalcohol resin, polyester resin, polyamide resin, urethane resin, and acrylic resin. The surface area of the dyeing layer which is in contact with the ink layer is not compatible with the ink layer.

It is also preferable that resin constituting a surface area of the dyeing layer which is in contact with the ink layer is at least one resin selected from the group consisting of polyvinyl butyral and polyvinyl acetal, and that resin constituting the ink layer is at least one resin selected from the group consisting of polyacrylonitrile styrene resin, polyvinylchloride resin, polyvinyl acetate resin, polyvinylalcohol resin, polyester resin, polyamide resin, urethane resin, and acrylic resin, and that the resin constituting the ink layer is at least one resin selected from the group consisting of polyvinyl butyral and polyvinyl acetal. Therefore, the surface area of the dyeing layer which is in contact with the ink layer will not be compatible with the ink layer.

It is further preferable that the dyeing layer has 10 g/25 mm–100 g/25 mm adhesion to the functional layer on the intermediate member. As a result, the dyeing layer is stably transferred onto the functional layer on the intermediate member, and the recording process becomes stable since the transfer of the dyeing layer onto the image-receptor is stable.

It is preferable that the base material is used as the first base material of the dyeing layer transfer member and as the second base material of the ink transfer member, so that the recording process is carried out in a small occupying space.

It is also preferable that the lubricating heat-resistant layer formed on the reverse surface of the base material contains at least one material selected from the group consisting of heat-resistant resin, inorganic or organic fine particles, and liquid lubricating material. Thus, the heat-resisting resin adds heat-resistant properties to the layer, and the inorganic or organic fine particles roughen the surface of the layer and further reduce the coefficient of dynamic friction to the thermal head. As a result, the transfer member can run stably during the recording process.

It is preferable that the liquid lubricating material is nonreactive silicone oil having functional groups at the side chains and a molecular weight more than 10,000. Therefore, the mobility of the liquid lubricating material in the lubricating heat-resistant layer is restricted, and the liquid lubricating material does not transfer to the dyeing layer or the ink layer while the transfer member is kept at high temperature for a long period by winding. As a result, contamination on the functional layer and the ink layer due to the liquid lubricating material is prevented, and the holding power of supporting the dyeing layer with the intermediate member is kept constant.

It is also preferable that the non-reactive silicone oil has a molecular weight of functional groups with a molecular weight larger than the molecular weight of dimethyl polysiloxane, like polyether-modified silicone having polyether groups with a molecular weight of 12,000 and dimethyl polysiloxane with a molecular weight of 6,000 sandwiched by the polyether groups. Thus, the non-reactive silicone oil is strongly restricted in the lubricating heat-resistant layer, thus reducing contamination of the functional layer and the ink layer caused by the liquid lubricating material during the recording process and further stabilizing the recording process.

The thermal transfer printing method of this invention includes the steps of thermally transferring a dyeing layer onto a functional layer of an intermediate member by setting a thermal head in contact with a lubricating heat-resistant layer of a dyeing layer transfer member, thermally transferring and recording dye in an ink layer onto the dyeing layer transferred on the functional layer in accordance with picture signals, and thermally transferring the dyeing layer recorded with the dye onto the surface of an image-receptor. The dyeing layer transfer member, having a lubricating heat-resistant layer on the reverse surface of a first substrate and a two-layer structure of a parting layer and a dyeing layer on the other surface, the ink transfer member, having the lubricating heat-resisting layer on the reverse surface of a second base material and a two-layer structure of an adhesive layer and the ink layer on the other surface, the intermediate member having the functional layer on a third base material, and the image-receptor are all used in the method. The dyeing layer is transferred onto the functional layer so as to set the area of the dyeing layer larger than the area of the image-receptor, thereby forming picture images over an area larger than the area of the image-receptor by thermally transferring and recording the dye in the ink layer onto the dyeing layer. The dyeing layer recorded with the picture images is transferred onto the image-receptor, and the sections of picture images outside the outer perimeter of the image-receptor are cut. Thus, the picture images are formed on the entire surface of the photo-receptor.

DETAILED DESCRIPTION OF THE INVENTION

This invention will be described by referring to the following illustrative examples and attached figures.

Figure 1:
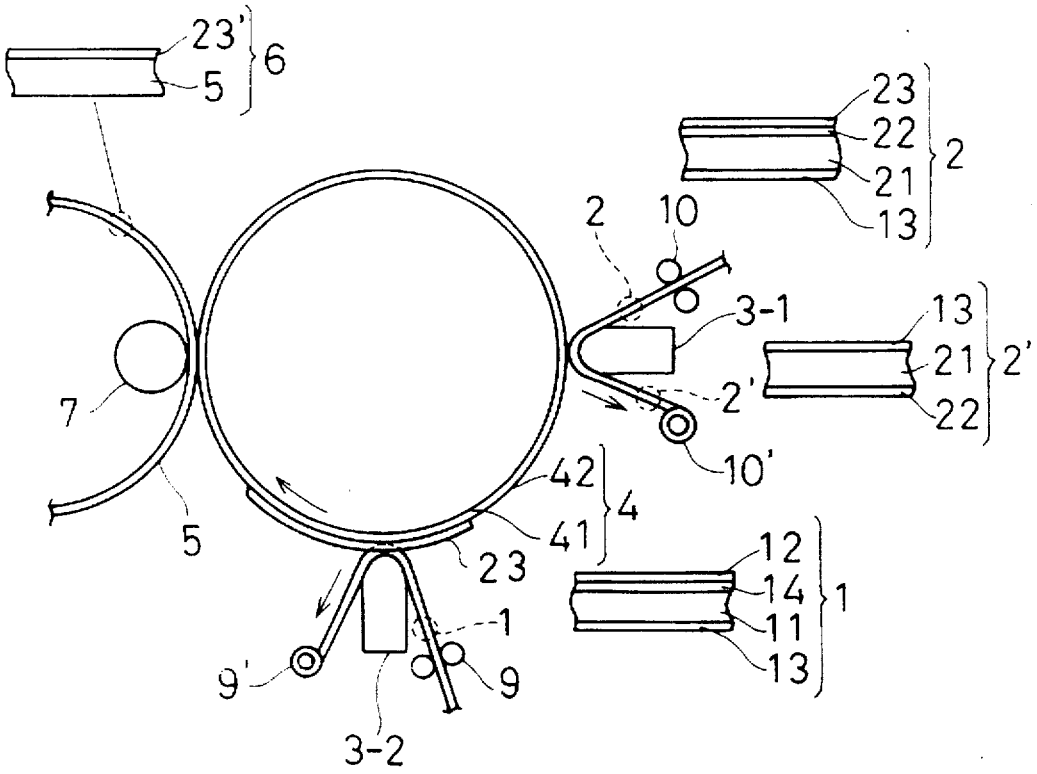
FIG. 1 is a cross-sectional view of an arrangement for a dye thermal transfer printing method applying a transfer member of an embodiment of the invention.

FIG. 1 is a cross-sectional view of an arrangement for the dye thermal transfer printing method applying the transfer member of the invention. In the figure, a dyeing layer transfer member 2, having a heat-resistant lubricating layer 13 on the reverse surface of a base material 21 and a two-layer structure of a parting layer 22 and a dyeing layer 23 on the obverse surface, is run between a drum-shaped intermediate member 4 and a thermal head 3-1 by a supply roller 10 and a winding roller 10'. A dyeing layer 23 of dyeing layer transfer member 2 is thermally transferred onto a functional layer 42 on a base material 41 of intermediate member 4. A belt-type or sheet-type intermediate member may also be used in the invention. The dyeing layer transfer member, after dyeing layer 23 was transferred, is shown as dyeing layer transfer member 2' in the figure. An ink transfer member 1, having a heat-resistant lubricating layer 13 on the reverse side of a base material 11 and a two-layer structure of an adhesive layer 14 and an ink layer 12 on the obverse side, is run between intermediate member 4 and a thermal head 3-2 by a supply roller 9 and a winding roller 9'. Subliming dye in ink layer 12 of ink transfer member 1 is thermally transferred onto dyeing layer 23 on intermediate member 4. Finally, picture images recorded in dyeing layer 23 are transferred onto image-receptor 5 along with the dyeing layer by a thermal roller 7, thus forming picture images of high quality on image-receptor 5 without being dependent on the quality of image-receptor 5. Dyeing layer 23', after being transferred onto image-receptor 5, is shown as dyeing layer 6. When intermediate member 6 is a sheet-type member, it is swung when dyeing layer 23 and the dye from ink layer 12 are transferred.

Figure 2:
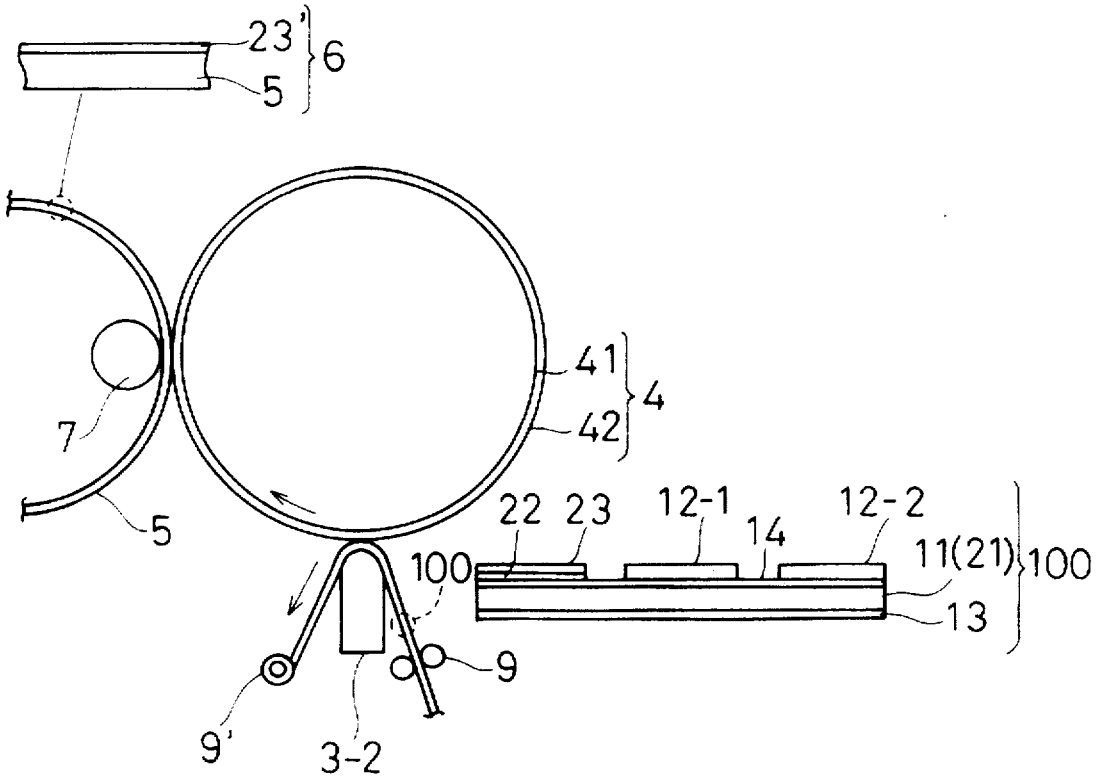
FIG. 2 is a cross-sectional view of an arrangement for the dye thermal transfer printing method applying a transfer member of another embodiment of the invention.

FIG. 2 is a cross-sectional view of an arrangement for the dye thermal transfer printing method applying a transfer member of the invention. A dyeing layer transfer member 1 and an ink transfer member 2 are combined in one body, thus constituting a transfer member 100. Transfer member 100 includes of a heat-resistant lubricating layer 13 on the reverse surface of a base material 11 (21), an adhesive layer 14 on the obverse surface, a parting layer 22 and a dyeing layer 23 sequentially formed at a first area on adhesive layer 14, an ink layer 12-1 at a second area on adhesive layer 14, and an ink layer 12-2 at a third area on adhering layer 14. Ink layer 12-1 and ink layer 12-2 are of different colors. The transfer member is run between an intermediate member 4 and a thermal head 3-2 by a supply roller 9 and a winding roller 9'. Dyeing layer 23 is first thermally transferred by thermal head 3-2. Then, the subliming dye in ink layers 12-1 and 12-2 are thermally transferred onto dyeing layer 23, which was already thermally transferred. The processes, after the subliming dye is transferred onto dyeing layer 23, are the same as the ones shown in FIG. 1.

Figure 3:
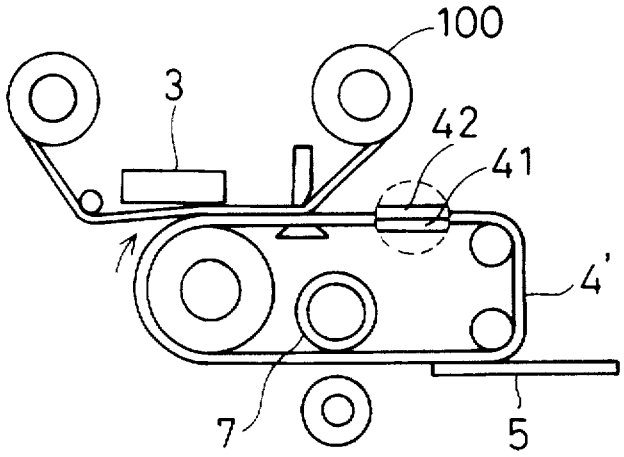
FIG. 3 is a cross-sectional view of an arrangement for the dye thermal transfer printing method applying a transfer member of another embodiment of the invention.
Figure 4:
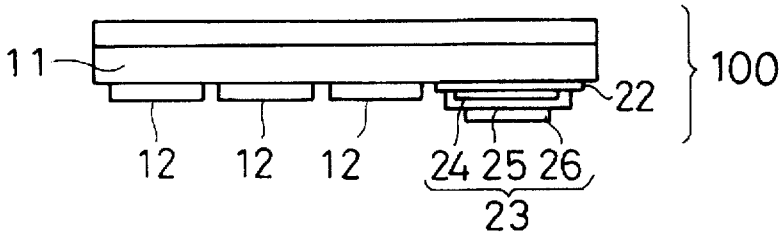
FIG. 4 is a cross-sectional view of the enlarged transfer member shown in FIG. 3.

FIG. 3 is a cross-sectional view of an arrangement for the dye thermal transfer printing method applying a transfer member. A transfer member 100, having the dyeing layer transfer member and ink transfer member of FIG. 2 on the same base material, and a belt-type intermediate member 4' are used in FIG. 3. Belt-type intermediate member 4' is spread and spanned by a platen, a guide roller, or the like. A dyeing layer 23 of transfer member 100 is transported to a section between intermediate member 4' and thermal head 3, so that dyeing layer 23 is thermally transferred onto functional layer 42 on a base material 41. Dyeing layer 23 is selectively transferred only for sections where dye will be recorded later or transferred onto a fixed area. Ink layer 12 of transfer member 100 is transported between intermediate member 4' and thermal head 3, so that subliming dye in ink layer 12 is thermally diffused and transferred onto dyeing layer 23 on intermediate member 4. Finally, picture images recorded in dyeing layer 23 on intermediate member 24 are thermally transferred onto image receptor 5 by thermal roller 7, thus providing picture images of high quality without being dependent on the quality of the base material.

A 2 or 10 micron thick polymer film is used as base material 11. In general, a polyethylene terephthalate (PET) film is used. Aromatic polyamide (aramide), polyimide, polycarbonate, polyphenylene sulfide, polyether ketone, triacetyl cellulose, cellophane, etc. may also be applied. A low resistance film which is formed by mixing conductive particles such as carbon in the above-noted resin may also be used.

Heat resistant lubricating layer 13 adds lubricating properties between the thermal head (3, 3-1 or 3-2) and base material (11 or 21). The layer contains at least heat-resistant resin such as ultraviolet-ray curing resin, liquid lubricating material, and organic or inorganic fine particles. The heat-resistant resin adds heat-resistant properties to the lubricating layer. The fine particles roughen the surface of the layer and reduce the coefficient of dynamic friction, so that the running of the layer becomes stable. A small quantity of the liquid lubricating material emerges from the inside to the surface of the layer because of thermal heads 3, 3-1 and 3-2, thus increasing the running stability of dyeing layer transfer member 1, ink transfer member 2 and transfer member 100. As the heat-resistant resin, thermoplastic resin can be applied. However, resins (cross-linking resins) which can be cured by heat, light (ultraviolet rays), electron beams or the like are preferable since they can provide stable heat-resistant properties. The curing resins include silicone resins, acrylate resins, epoxy resins, unsaturated aldehyde resins, and the like. Among these resins, epoxyacrylate resins have superior properties. The inorganic fine particles include metal, metal oxide, sulfide, carbide, nitride or fluoride fine particles, and graphite, carbon black and pigment. Among these fine particles, preferable particles are titanium oxide, molybdenum disulfide and hydrophobic (anhydrous) silica, more preferably hydrophobic (anhydrous) silica, titanium oxide or aluminum oxide fine particles prepared by a vapor phase growth method. The organic fine particles include spherical silicone resin fine particles and the like.

As the liquid lubricating material, a fluororcarbon surface active agent such as dirutile polysiloxane silicone oil, fluorocarbon silicone oil, modified silicone oils (epoxy, polyether, amino or carboxyl modified silicone oils), organic metallic salt and fluoroalkyl compound is applicable. When a liquid lubricating material is applied which has functional groups on the side chains and is nonreactive silicone oil having a molecular weight more than 10,000, the free mobility of silicone oil in the lubricating heat-resistant layer is restricted. Thus, the transfer of silicone oil onto the surface of dyeing layer 23 or the surface of ink layer 12 is prevented, which can occur when the transfer member is wound and preserved at high temperature for a long time. Moreover, when the molecular weight of molecular side chain functional group sections sandwiched with the dimethyl polysiloxane sections of non-reactive silicone oil is larger than that of the dimethyl polysiloxane section sandwiched with molecular side chain functional group sections, the force of constraint of silicone oil in the lubricating heat-resistant layer further improves. In addition, the transfer of silicone oil to the surface of dyeing layer 23 or of ink layer 12 is further controlled. For example, the liquid lubricating material is polyether modified silicone oil having a molecular weight of 18,000 (6,000 molecular weight at the siloxane sections and a molecular weight of 12,000 at the functional groups). With the application of a non-reactive silicone oil having a molecular weight more than 10,000 as the liquid lubricating material, the surface of functional layer 42 and ink layer 12 of intermediate members 4 and 4' is not contaminated by silicone oil during recording, and the adhesion of dyeing layer 23 on intermediate members 4 and 4' is kept constant. Especially when nonreactive silicone oil has the side chain functional groups of higher molecular weight sandwiched with dimethyl polysiloxane sections, the adhesion of the dyeing layer on intermediate members 4 and 4' is kept constant at a high level.

Figure 5:
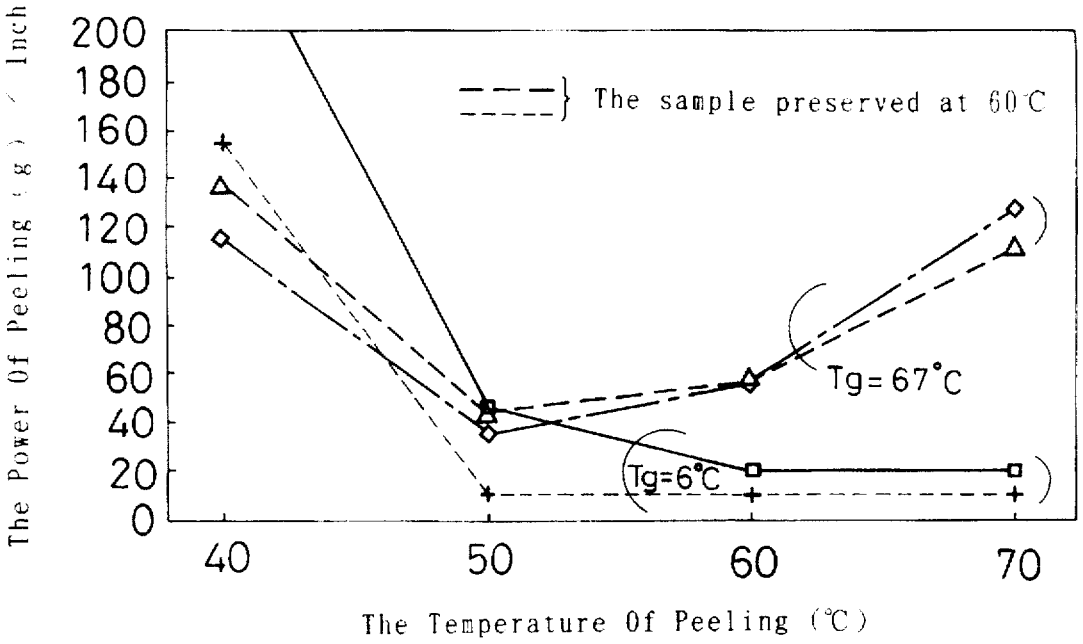
FIG. 5 is a graph showing a correlation between temperature and peeling force between an ink layer and a dyeing layer.

Adhesive layer 14 is generally formed on base materials 11 and 21, and the thickness of the layer to be combined with the base material is less than 0.5 μm. When a polyester film is applied as base material 11, a random copolymer polyester resin is applied as the adhesive layer. Generally, in order to maintain high adhesive strength with ink layer 12 around room temperature, a polyester resin is used having a glass transition point (Tg) at around room temperature. However, in the thermal transfer printing method of this invention, the surface temperature of the intermediate member is kept at 50°–60° C. Ink layer 12 has to be well-adhered to base materials 11 and 21 even at temperatures higher than 50° C. so as to prevent blocking phenomenon or the like caused by adhesion between ink layer 12 and dyeing layer 23 during recording. Thus, the glass transition point (Tg) of the resin constituting adhesive layer 14 is preferably higher than 40° C. Moreover, polyester resin having a Tg higher than 60° C. is stable even when a device is placed in a high temperature condition. The maximum peeling force of polyester resin having a 67° C. Tg (VYLON 200 manufactured by TOYOBO CO., LTD.) is found around 60° C., and that of polyester resin having a 6° C. Tg (VYLON 300 manufactured by TOYOBO CO., LTD.) is found around room temperature. When the temperature rises, the peeling force of the resins declines. FIG. 5 shows the correlation between temperature and peeling force of ink layer 12 and adhesive layer 14 while a transfer member using VYLON 200 as adhesive layer 14 and a transfer member using VYLON 300 as adhering layer 14 are applied. The transfer members were wound and preserved on a 60° C. and 60% RH thermostatic layer for 300 hours, and the peeling force and temperature were then measured. It is necessary to set the peeling force between an ink layer and an adhesive layer larger than the peeling force between an ink layer and a dyeing layer at any recording temperature so as to carry out stable recording processes. The peeling force between an ink layer and a dyeing layer is less than 20 g/inch at 50° C., so that the peeling force between an ink layer and an adhesive layer should be higher than 20 g/inch. Thus, when a resin having a Tg higher than 40° C. is used as a resin constituting adhesive layer 14, recording processes become stable even at high temperature.

Ink layer 12 includes of subliming dye and binding resin. The subliming dye includes disperse dye, oil color, basic dye, color former, etc. Particularly, a disperse dye such as indoaniline, quinophthalon, dicyanoimidazole, dicyanomethyn, tricyanovinyl disperse dyes is useful. Binding resin includes polyester, polyvinyl butyral, polyacrylonitrile sutyrene resin, polyvinylchloride resin, polyvinyl acetate resin, polyvinylalcohol resin, polyvinyl acetal resin, polyamide resin, acrylic resin, urethane resin, low molecular weight polystyrene resin, and the like. These resins can also be used as a constituting resin for dyeing layer 23. The binding resin of ink layer 12 preferably is not compatible with the constituting resin of dyeing layer 23, so that ink layer 12 does not thermally adhere to dyeing layer 23 during recording and the ink layer can be easily peeled off after recording. When a resin such as polyester and polyvinyl butyral is used as a constituting resin in dyeing layer 23, the binding resin of ink layer 12 is polyacrylonitrile styrene (AS) resin, polyvinylchloride resin, polyvinyl acetate resin, polyvinylalcohol resin, or a mixed resin containing at least two of AS resin, polyvinylchloride resin, polyvinyl acetate resin and polyvinylalcohol resin. When polyester, polyvinyl butyral, or the like is used as the binding resin of ink layer 12, the resin constituting dyeing layer 23 is polyacrylonitrile styrene (AS) resin, polyvinylchloride resin, polyvinyl acetate resin, polyvinylalcohol resin, or a mixed resin containing at least two of AS resin, polyvinylchloride resin, polyvinyl acetate resin and polyvinylalcohol resin. The compatibility of the resin is evaluated by the solubility parameter, critical surface tension, contact angle or the like. For example, while the critical surface tension (F) of polyvinyl butyral is about 24 dyne/cm, the F of dyeing or ink layer resin is above 30. The soluble parameter of polyvinyl butyral is about 7, close to the parameter of Teflon which is 6, and that of dyeing or ink layer resin is mostly above 9.

AS resin has 104° C. Tg, and has suitable heat-resistant properties when it is used as the binding resin of ink layer 12. However, the adhesion of the resin with adhesive layer 14 is not satisfactory. Binding resin is added to ink layer 12 which is prepared by mixing AS resin with a copolymer resin (Tg= 64° C.) of polyvinylchloride resin, polyvinyl acetate resin and polyvinylalcohol resin having high adhesiveness with adhesive layer 14 and flexibility, so that both the winding and preserving properties and the stable recording properties of transfer member 1 are satisfied. The ratio between the AS resin and the copolymer resin is preferably 2:8 or 8:2.

The dyeing layer transfer member is prepared by laminating a parting layer 22 and a dyeing layer 23 on a base material 21 (11). Parting layer 22 is a thin silicone resin, fluorocarbon resin, or the like. A resin in which a releasing material is mixed, dispersed or reacted can also be applied. It is preferable that a silicone resin is formed as a film by addition polymerization or condensation polymerization. Fluorocarbon resin includes polytetrafluoroethylene, tetrafluoroethylene • perfluoroalkyl vinylether copolymer, vinylidene fluoride • hexafluoropropylene rubber, and the like. As a parting material added to the resin, silicone lubricating materials, fluorocarbon surface active agents, wax such as paraffin and polyethylene, higher fatty acid alcohol, and higher fatty acid amide and ester are included. The liquid lubricating material includes modified silicone oil such as dimethyl polysiloxane, methylphenyl polysiloxane and fluorocarbon silicone oil, and the reactant of two or more kinds of reactive silicone oil (for example, the reactant of epoxy modified oil and carboxyl or amino modified oil). Moreover, a water-soluble polysiloxane graft acrylic resin which is prepared by graft polymerizing polysiloxane with acrylic resin, or an acrylic silicone (silicone) resin or acrylic urethane silicone (silicone) resin having siloxane methacrylate at the end or side chains is also effective.

Dyeing layer 23 is preferably a two-layer structure of a first dyeing layer 24, which is in contact with releasing layer 22 on base material 21 (11), and a protective layer 25, or a three-layer structure of first dyeing layer 24, protective layer 25, and an intensity reinforcing layer 26. It is preferable that the heat-resistant property of reinforcing layer 26 is higher than that of protective layer 25, and that the same property of protective layer 25 is higher than that of first dyeing layer 24. Since first dyeing layer 24 has a low heat-resistant property, recording sensitivity is improved by setting the dyeing layer in contact with ink layer 12 during recording processes. Protective layer 25 or reinforcing layer 26 having a high heat-resistant property is in contact with lubricating heat-resistant layer 13 during winding and preserving processes at high temperature, thus preventing adherence between dyeing layer 23 and lubricating heat-resistant layer 13. In consideration of forming a laminated film, first dyeing layer 24 and protective layer 25, or first dyeing layer 24, protective layer 25 and reinforcing layer 26 preferably include the same resin. As a result, it becomes possible to print and form a laminated film with even film properties. When the film is formed by gravure, the thickness of one layer is 3–4 μm. Thus, first dyeing layer 24 alone is not thick enough, so that the three-layer structure having reinforcing layer 26 is preferable to stabilize the recording processes.

The two-layer or three-layer structure dyeing layer 23 preferably has the following composition. First dyeing layer 24 contains polyvinyl butyral resin or polyvinyl acetal resin having a glass transition point (Tg) less than 60° C. Protective layer 25 includes a mixed resin of various polybutyral resins or polyvinyl acetal resins having glass transition points (Tg) above 70° C. and different from each other. The protective layer covers the entire surface of first dyeing layer 24. Reinforcing layer 26 contains polyvinyl butyral resin or polyvinyl acetal resin having a glass transition point (Tg) above 100° C., has an area smaller than the outer circumference of protective layer 25, and has heat-resistant properties higher than protective layer 25.

Intermediate member 4 includes a functional layer 42 on a metallic drum or polymer film base material 41. Functional layer 42 is a thinned rubber-type layer made of silicone resin or fluorocarbon resin. Or, besides silicone resin and fluorocarbon resin, another resin, in which a releasing agent is mixed, dispersed or reacted, is used to form the functional layer. It is preferable to use silicone resin which can form a layer by addition polymerization or condensation polymerization. The fluorocarbon resin includes polytetrafluoroethylene, tetrafluoroethylene • perfluoroalkylvinylether copolymer, vinylidenefluoride • hexafluoropropylene rubber material, fluorocarbon resins, and the like. Particularly, terpolymer fluorinated rubber of vinylidene fluoride, hexafluoropropylene and tetrafluoroethylene (Viton manufactured by SHOWA DENKO • DUPON K. K.) is effective. The terpolymer fluorinated rubber is used with fine particles such as carbon and magnesium oxide.

Image-receptor 5 may be pulp-based paper such as bond paper and plain paper. Synthetic paper such as milky-white color PET and kerogen, or a material in which a film is adhered to pulp paper may also be used. The image-receptor may also be a card such as a telephone card, a private card and an IC card. In the conventional technology, picture images are formed with an unrecorded empty space at the peripheral section of an image-receptor. When image-receptor 5 is hard and rigid like a post card and other cards, picture images are formed on the entire surface of the image-receptor in this invention. In other words, dyeing layer 23 is transferred onto intermediate members 4 and 4' over an area larger than the area of image-receptor 5. After large picture images are formed on dyeing layer 23 over an area larger than the area of image-receptor 5, dyeing layer 23 is transferred onto image-receptor 5 while the layer is cut off at the peripheral section of image-receptor 5, such as a card. Dyeing layer 23 remaining on intermediate member 4 is removed by a cleaning device after dyeing layer 23 is transferred onto image-receptor 5.

As a recording head, a regular thermal head, an electrode head, a laser head, or the like is applied. With the application of a line-type thermal head, line recording frequency (T) is 33 ms or 4 ms; application pulse width is 16 ms or 2 ms; and recording energy (E) is 8 or 6 J/cm$^2$.

The recorded dyeing layer is thermally transferred onto image-receptor 5 by a thermal roller 7 at about 140° C., 10 mm/second, and 1 Kg/cm$^2$ pressure.

As described above, the transfer member of this invention can carry out thermal transfer printing stably and repeatedly, forming pictorial images of high quality without being dependent on the quality of image-receptors. Moreover, picture images are formed over the entire surface of image-receptors in this invention, a difficult object to obtain in conventional thermal transfer printing methods.

This invention is explained in a further detail by referring to the following examples.

EXAMPLE 1

(Preparation of Ink Transfer Member)

A 2 micron thick lubricating heat-resistant layer was formed on the reverse surface of a 5 micron thick PET film. On the obverse surface, a 0.3 micron thick random copolymer polyester resin having 67° C. Tg was coated as an adhesive layer. Then, ink containing the materials mentioned below was coated on the adhesive layer at a thickness of one micron by a gravure coater, thus forming a coloring layer. The lubricating heat-resistant layer was formed by coating a coating material including the following materials with a micro-gravure coater, evaporating a solvent with 60° C. heated air, and curing with the irradiation of a 1 KW high pressure mercury lamp.

| <Ink> | |
|---|---|
| Indoaniline disperse dye | 2.5 weight parts |
| Acrylic styrene | 2.0 weight parts |
| Polyvinylchloride copolymer resin | 2.0 weight parts |
| Amide modified silicone oil | 0.02 weight parts |
| Toluene | 20 weight parts |
| 2-butanon | 20 weight parts |
| **<Coating Material>** | |
| Epoxyacrylate resin | 12 weight parts |
| Neopentylglycol diacrylate | 3 weight parts |
| 2-hydroxy-2-methylpropiophenone | 0.75 weight parts |
| Aerosil (trade name of hydrophobic ultra-fine particles) | 2 weight parts |
| Polyether modified dimethyl silicone (18,000 molecular weight) | 0.4 weight parts |
| Ethyl acetate | 100 weight parts |

(Preparation of Dyeing Layer Transfer Member 2)

The same PET base material, adhesive layer and lubricating heat-resistant layer as applied for the ink transfer member were used. On the adhesive layer, a coating material, consisting of 10 weight parts of deoxime-type silicone resin, i.e., silicone resin in which oxime is generated during a curing reaction (PRX305 manufactured by Torey • Dow • Silicone Industries, Inc.) and 20 weight parts of toluene, was coated at 0.3 micron thickness by a bar coater as a parting layer. On the parting layer, a coating material, including 6 weight parts of polyvinyl butyral resin having 55° C. Tg (BL-S manufactured by Shimizu Chemical Co., Ltd.), 0.06 weight parts of acrylic silicone (silicone) resin having siloxane acrylate at side chains (F-6A manufactured by SANYO CHEMICAL INDUSTRIES, LTD.), 0.004 weight parts of di-n-butyltin dilaurate, 13 weight parts of toluene, and 13 weight parts of 2-butanone, was coated at 1 micron thickness by a bar coater. A 1.5 micron thick protective layer was formed on the parting layer by applying a material which includes polyvinylbutyral resin having 75° C. (Tg) and acetoacetalizing polyvinyl alcohol resin (acetal resin) having 110° C. (Tg) at a rate of 6:4. The material including these resins at a rate of 3:7 was applied so as to form a 1.5 micron thick layer.

(Preparation of Intermediate Member 4)

The coating material mentioned below was applied so as to form an approximately 30 micron thick functional layer on a 50 micron thick polyimide film on a metallic drum. Without using the metallic drum, a polyimide formed with the functional layer may be used as a belt.

| <Coating Material for Functional Layer> | |
|---|---|
| Fluorocarbon rubber | 100 weight parts |
| Vulcanizing agent | 3 weight parts |
| Carbon | 20 weight parts |
| Magnesium oxide | 15 weight parts |
| Methylethyl ketone | 350 weight parts |

By using a thermal roller mechanism which transfers a dyeing layer onto the above-mentioned ink transfer member 1, dyeing layer transfer member 2, intermediate member 4 and the image-receptor, recording was carried out under the following conditions and final picture images were formed on bond paper.

Recording head: line-type thermal head

Line recording speed: 8 ms

Recording pulse width: 0–4 ms

Maximum dye recording energy: 6.5 J/cm$^2$

Dyeing layer transferring energy: 4 J/cm$^2$

Thermal roller: 140° C., 10 mm/second feed speed, 5 kg pressure

The images formed on bond paper were pictorial images of high quality having more than 1.8 maximum reflection density. The picture images were formed repeatedly, and the high quality of the pictorial images was maintained.

EXAMPLE 2

(Preparation of Ink Transfer Member 1)

On the reverse surface of a 4.5 micron PET film, a 1 or 2 micron lubricating heat-resistant layer was applied. On the obverse surface, a 0.3 micron random copolymer polyester resin having 67° C. (Tg) was coated as an adhesive layer. Ink composed of the following materials was coated on the adhesive layer, thus forming a 0.7 micron ink layer. The lubricating heat-resistant layer was formed as in Example 1.

| <Ink> | |
|---|---|
| Indoaniline disperse dye | 2.5 weight parts |
| Polyvinyl butyral resin | 4 weight parts |
| Amide modified silicone oil | 0.02 weight parts |
| Toluene | 20 weight parts |
| 2-butanon | 20 weight parts |

(Preparation of Dyeing Layer Transfer Member 2)

The same PET base material, adhesive layer and lubricating heat-resistant layer as applied to the ink transfer member were used. On the adhesive layer, a coating material, composed of 10 weight parts of deoxime-type silicone resin, i.e., silicone resin in which oxime is generated during a curing reaction (PRX305 manufactured by Toray • Dow • Silicone Industries, Inc.) and 20 weight parts of toluene, was applied as a parting layer at 0.3 micron thickness by a bar coater. On the parting layer, a coating material, composed of 6 weight parts of a mixed resin of polyvinylchloride • vinyl acetate copolymer and polyacrylonitrile sutyrene resin, 0.06 weight parts of a curing reaction product of amino modified silicone and epoxy modified silicone as a releasing agent, 13 weight parts of toluene, and 13 weight parts of 2-butanone, was coated at 1 micron by a bar coater, thus forming a first dyeing layer. As a protective layer, a material including polyvinyl butyral resin having 75° C. (Tg) and acetoacetalizing polyvinyl alcohol resin (acetal resin) having 110° C. (Tg) at 6:4 was coated at 1.5 micron on the first dyeing layer. Another layer was formed on the protective layer by forming a 1.5 micron acetal resin layer.

(Intermediate Member 4)

The member applied in Example 1 was used in this example. The same experiment as in Example 1 was carried out while a thermal roller mechanism, which transfers a dyeing layer onto dyeing layer transfer member 1, ink transfer member 2, intermediate member 4 and the image-receptor, was applied. The same results as in Example 1 were obtained.

The invention may be embodied in other forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A transfer system comprising a dyeing layer transfer member comprising a lubricating heat-resistant layer on a reverse surface of a first base material and laminated layers of a parting layer and a dyeing layer on an obverse surface of said first base material, an ink transfer member comprising a lubricating heat-resistant layer on a reverse surface of a second base material and laminated layers of an adhesive layer and an ink layer on an obverse surface of said second base material, an intermediate member comprising a functional layer that accepts the dyeing layer on a third base material, and an image-receptor; whereby said transfer system is suitable for conducting thermal transfer printing processes comprising the steps of thermally transferring said dyeing layer onto said functional layer by setting a thermal head in contact with said lubricating heat-resistant layer of said dyeing layer transfer member, thermally transferring dye of said ink layer to said dyeing layer already transferred onto said functional layer in response to image signals by setting a thermal head in contact with said lubricating heat-resistant layer of said ink transfer member, and thermally transferring said dyeing layer recorded with dye onto a main surface of said image-receptor; and wherein heat-resistant properties of said dyeing layer gradually increase from a surface in contact with said parting layer to an outside surface of said dyeing layer.

2. The transfer system of claim 1, wherein the dyeing layer has adhesiveness of 10 g/25 mm–100 g/25 mm with respect to the functional layer on the intermediate member.

3. The transfer system of claim 1 wherein the same base material is used as the first base material formed with the dyeing layer transfer member and as the second base material formed with the ink transfer member.

4. The transfer system of claim 1, wherein the lubricating heat-resistant layer formed on the reverse surface of the base material comprises at least heat-resistant resin, inorganic or organic fine particles, and liquid lubricating material.

* * * * *